US010520865B2

(12) United States Patent
Takahashi

(10) Patent No.: US 10,520,865 B2
(45) Date of Patent: Dec. 31, 2019

(54) FIXING DEVICE, IMAGE FORMING APPARATUS AND HOLDING MEMBER FORMING METHOD

(71) Applicant: KYOCERA Document Solutions Inc., Osaka (JP)

(72) Inventor: Hironori Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/154,008

(22) Filed: Oct. 8, 2018

(65) Prior Publication Data

US 2019/0187592 A1 Jun. 20, 2019

(30) Foreign Application Priority Data

Dec. 14, 2017 (JP) ..... 2017-239472

(51) Int. Cl.
*G03G 15/20* (2006.01)
*G03G 15/16* (2006.01)

(52) U.S. Cl.
CPC ..... *G03G 15/2039* (2013.01); *G03G 15/161* (2013.01); *G03G 15/2053* (2013.01); *G03G 15/2064* (2013.01); *G03G 2215/2035* (2013.01)

(58) Field of Classification Search
CPC ..... G03G 15/2053; G03G 15/161; G03G 2215/2035; G03G 2215/2064
See application file for complete search history.

(56) References Cited

U.S. PATENT DOCUMENTS

| | | | | |
|---|---|---|---|---|
| 5,790,926 | A * | 8/1998 | Mizoe | G03G 15/0233 361/221 |
| 8,682,218 | B2 | 3/2014 | Yamaguchi et al. | |
| 2010/0104335 | A1* | 4/2010 | Kamimura | G03G 15/2053 399/333 |
| 2011/0222931 | A1* | 9/2011 | Shinshi | G03G 15/2064 399/329 |
| 2016/0334741 | A1* | 11/2016 | Takahashi | G03G 15/2053 |

FOREIGN PATENT DOCUMENTS

JP 2012-128219 A 7/2012

* cited by examiner

*Primary Examiner* — Walter L Lindsay, Jr.
*Assistant Examiner* — Jessica L Eley
(74) *Attorney, Agent, or Firm* — Studebaker & Brackett PC

(57) ABSTRACT

A fixing device includes a fixing member, a heat source, a pressing member and a holding member. The holding member includes a base plate and a sliding sheet. The base plate includes a main body and a projection. The main body has one face facing an inner circumferential face of the fixing member and the other face opposite to the one face. The projection is formed on the other face. The sliding sheet has a through hole into which the projection is fitted. The sliding sheet is wrapped around the main body with the projection fitted into the through hole. The sliding sheet is subjected to a heat treatment at a temperature higher than a maximum temperature where a temperature of the fixing member reaches when the fixing member is heated by the heat source.

8 Claims, 6 Drawing Sheets

Related Art

FIXING DEVICE, IMAGE FORMING APPARATUS AND HOLDING MEMBER FORMING METHOD

INCORPORATION BY REFERENCE

This application is based on and claims the benefit of priority from Japanese Patent application No. 2017-239472 filed on Dec. 14, 2017, which is incorporated by reference in its entirety.

BACKGROUND

The present disclosure relates to a fixing device to fix a toner image on a sheet, an image forming apparatus including the fixing device and a holding member forming method.

In the fixing device, between a heating member, such as a fixing belt or a fixing roller, and a pressing member, such as a pressing roller, a pressing area is formed. When a sheet on which a toner image is transferred is passed through the pressing area, the toner image is heated and pressed to be fixed on the sheet. In a case where the fixing belt is employed as the heating member, a holding member configured to hold the fixing belt to the pressing member is provided.

The fixing device is sometimes provided with a nip forming member, as the holding member, including a base plate and a sliding sheet wrapped around the base plate. The base plate has projections on the face opposite to a nip area (the pressing area). The sliding sheet has openings into which the projections are fitted. The sliding sheet is wrapped around the base plate with the projections fitted into the openings.

However, in the above fixing device, in order to make it easier to fit the projections of the base plate into the openings of the sliding sheet, the sliding sheet has a length longer than a length where the sliding sheet is wrapped around an outer circumference of the base plate closely. Thereby, in a state where the projections are fitted into the openings, the sliding sheet is wrapped around the base plate with a loosed portion. When the fixing belt is rotated in the state where the sliding sheet is wrapped around the base plate with the loosed portion, the sliding sheet is pulled downstream, and the loosed portion is expanded downstream. Then, the expanded loosed portion is slid to the fixing belt, and rotation load of the fixing belt becomes large. As a result, a sheet jam easily occurs owing to rotation failure of the fixing belt.

SUMMARY

In accordance with an aspect of the present disclosure, a fixing device includes a fixing member, a heat source, a pressing member and a holding member. The fixing member is rotatable and endless. The heat source is configured to heat the fixing member. The pressing member is configured to form a pressing area between the fixing member and the pressing member. A sheet passes through the pressing area. The holding member is configured to come into contact with an inner circumferential face of the fixing member at the pressing area and to hold the fixing member to the pressing member. The holding member includes a base plate and a sliding sheet. The base plate includes a main body and a projection. The main body has one face facing the inner circumferential face of the fixing member and the other face opposite to the one face. The projection is formed on the other face. The sliding sheet has a through hole into which the projection is fitted. The sliding sheet is wrapped around the main body with the projection fitted into the through hole to be attached to the base plate. The sliding sheet is configured to slide with respect to the inner circumferential face of the fixing member. The sliding sheet is subjected to a heat treatment at a temperature higher than a maximum temperature where a temperature of the fixing member reaches when the fixing member is heated by the heat source.

In accordance with an aspect of the present disclosure, an image forming apparatus includes an image forming part and the fixing device. The image forming part is configured to form a toner image on a sheet. The fixing device is configured to fix the toner image on the sheet.

In accordance with an aspect of the present disclosure, a method to form the holding member of the fixing device includes a step to wrap the sliding sheet around the main body and to fit the projection and a fixing pin into the through hole and a fixing hole respectively; a step to insert a fastening member around the fixing pin and to put the sliding sheet between the fastening member and the main body; and a step to subject the sliding sheet put between the fastening member and the main body to a heat treatment at a temperature higher than a maximum temperature where a temperature of the fixing member reaches when the fixing member is heated by the heat source.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming apparatus and a fixing device of the present disclosure will be described.

Figure 1:
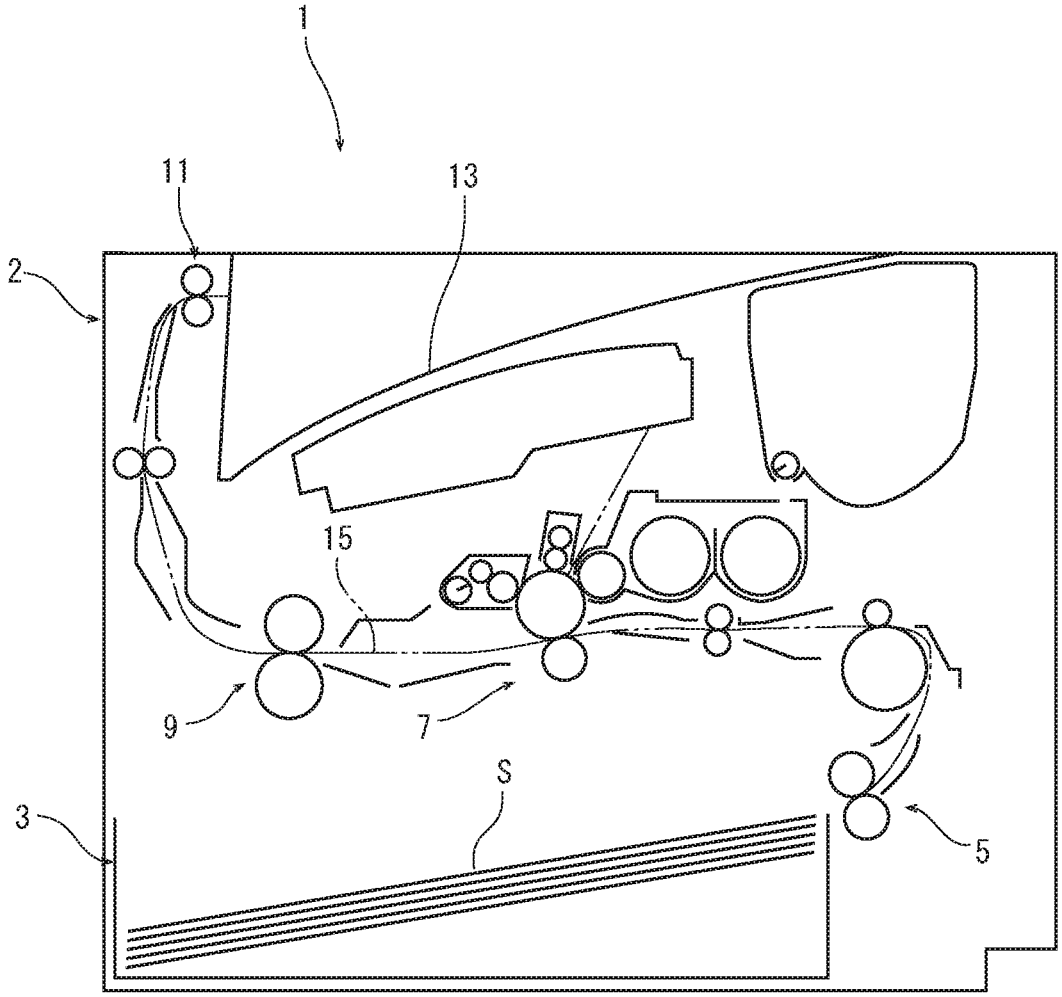
FIG. 1 is a front view schematically showing an inner structure of a printer according to one embodiment of the present disclosure.

First, with reference to FIG. 1, an entire structure of a printer as an image forming apparatus will be described. FIG. 1 is a front view schematically showing an inner structure of the printer. In the following description, a near side of a paper surface of FIG. 1 is set to a front side of the printer.

An apparatus main body 2 of the printer 1 is provided with a sheet feeding cassette 3 storing a sheet S, a sheet feeding device 5 feeding the sheet S from the sheet feeding cassette 3, an image forming part 7 forming a toner image on the sheet S, a fixing device 9 fixing the toner image on the sheet S, an ejecting device 11 ejecting the sheet S and an ejected sheet tray 13 on which the ejected sheet S is stacked. In the apparatus main body 2, a conveyance path 15 for the sheet S is formed so as to extend from the sheet feeding device 5 to the ejecting device 11 through the image forming part 7 and the fixing device 9.

Figure 2:
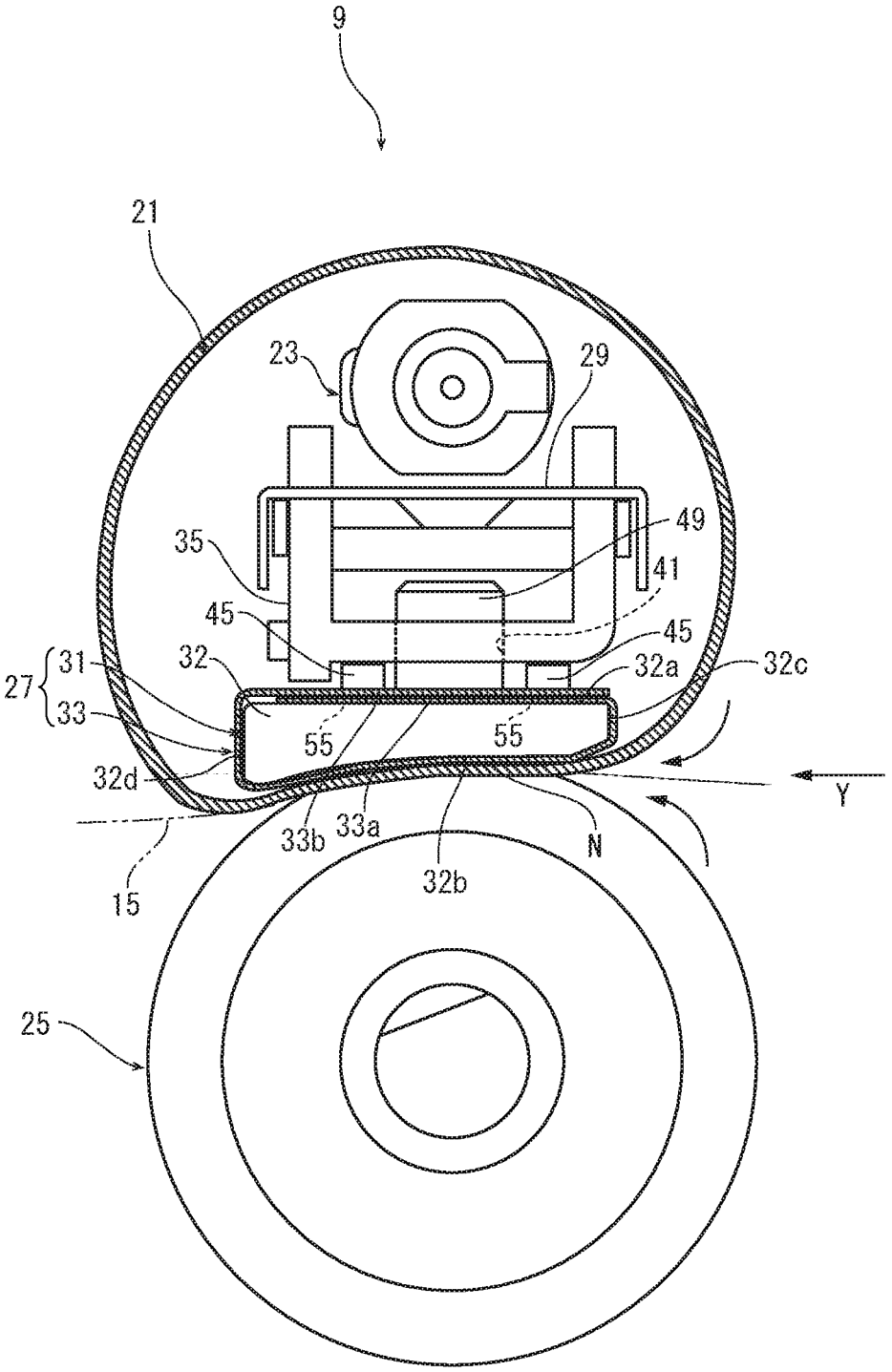
FIG. 2 is a sectional view showing a fixing device according to the embodiment of the present disclosure.
Figure 3:
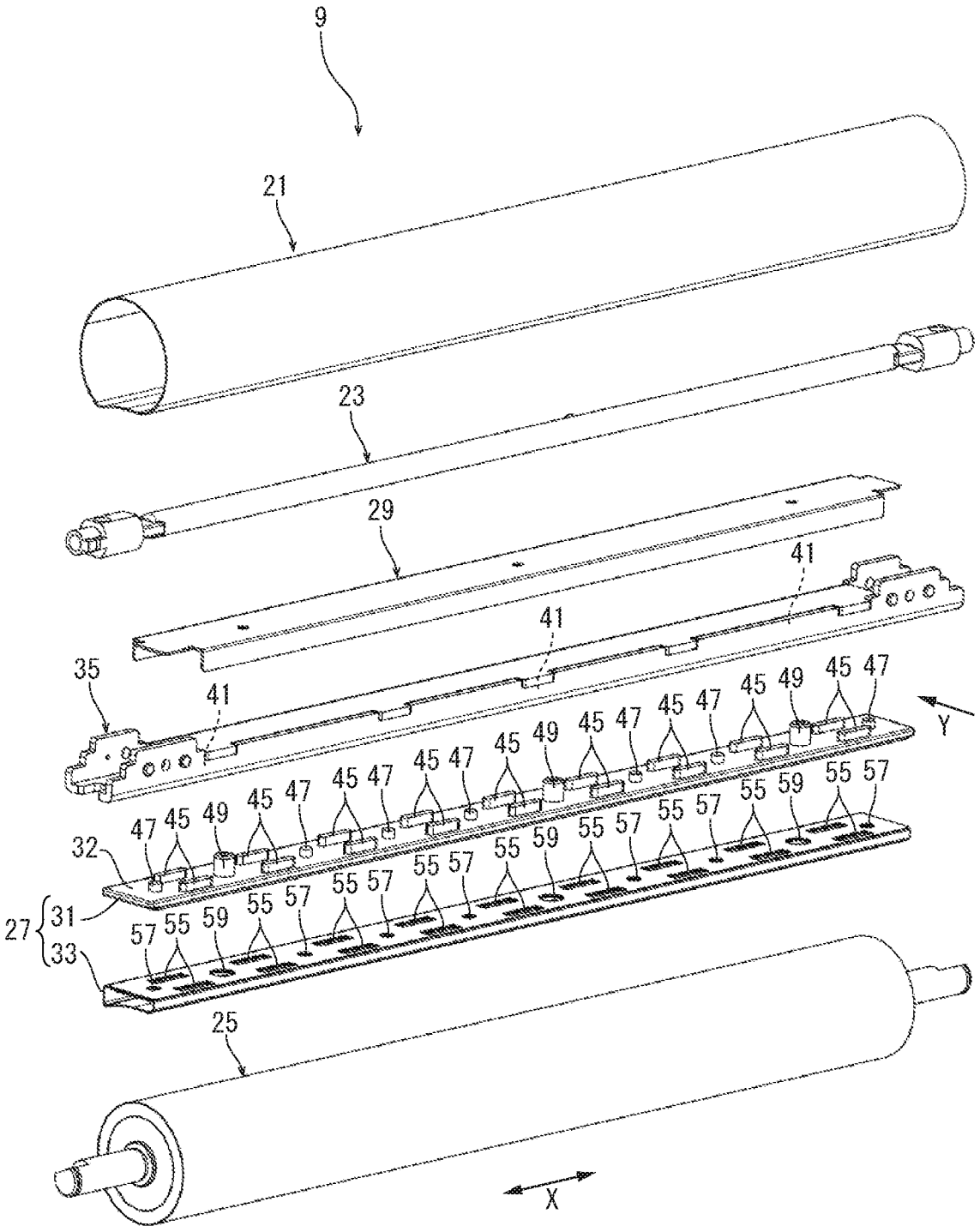
FIG. 3 is a disassembled perspective view showing the fixing device according to the embodiment of the present disclosure.

With reference to FIG. 2 and FIG. 3, the fixing device 9 will be described. FIG. 2 is a sectional view showing the fixing device and FIG. 3 is a disassembled perspective view showing the fixing device.

The fixing device 9 includes a fixing belt 21 as a fixing member, a heater 23 as a heat source heating the fixing belt 21, a pressing roller 25 as a pressing member forming a pressing area N between the fixing belt 21 and the pressing member and a holding member 27 holding the fixing belt 21 to the pressing roller 25 at the pressing area N.

The fixing belt 21 is an endless belt having a predetermined inner diameter and a width wider than a width of the sheet S. The fixing belt 21 is made of flexible material, and includes a base layer, an elastic layer provided around an outer circumferential face of the base layer and a release layer provided around an outer circumferential face of the elastic layer. The base layer is made of metal, such as SUS and Ni, for example. The elastic layer is made of silicon rubber, for example. The release layer is made of PFA tube, for example. A sliding layer may be provided around an inner circumferential face of the base layer. The sliding layer is made of polyimidoamide or PTFE, for example. The fixing belt 21 is supported in a rotatable manner.

The heater 23 is a halogen heater having the substantially same length as the width of the fixing belt 21. The heater 23 is arranged in an upper portion of a hollow space of the fixing belt 21. The heater 23 radiates radiant heat to an inner circumferential face of the fixing belt 21 to heat the fixing belt 21 to a predetermined temperature. Below the heater 23, a reflection plate 29 is arranged. The reflection plate 29 is a plate-shaped member having the substantially same length as the heater 23. The reflection plate 29 reflects the heat radiated from the heater 23 to the inner circumferential face of the fixing belt 21.

The pressing roller 25 includes a core metal, an elastic layer provided around an outer circumferential face of the core metal and a release layer provided around an outer circumferential face of the elastic layer. The elastic layer is made of silicon rubber, for example. The release layer is made of PFA tube, for example.

The pressing roller 25 is arranged below the fixing belt 21, and comes into contact with the fixing belt 21. Between the fixing belt 21 and the pressing roller 25, the pressing area N is formed. The pressing roller 25 is connected to a motor (not shown), and is driven by the motor to be rotated. When the pressing roller 25 is driven by the motor to be rotated in the counterclockwise direction in FIG. 2, the fixing belt 21 is driven by the pressing roller 25 to be rotated in the clockwise direction opposite to the rotation direction of the pressing roller 25. As a result, the conveyed sheet S passes through the pressing area N along a conveyance direction.

The holding member 27 includes a base plate 31 and a sliding sheet 33 wrapped around the base plate 31 and fastened to the base plate 31. The holding member 27 is supported by a stay 35.

The stay 35 is a channel-shaped member whose upper face opened, and has a length longer than the width of the fixing belt 21. The stay 35 has three positioning holes 41. The three projection holes 41 are formed in a bottom plate of the stay 35 at predetermined intervals along the width direction W. The stay 35 penetrates through the hollow space of the fixing belt 21. The above described reflection plate 29 is supported on the upper face of the stay 35.

The base plate 31 includes a main body 32, eighteen projections 45 and seven fixing pins 47 and three positioning pins 49 which are formed on the main body 32. The main body 32 is formed in a substantially shallow parallelepiped shape having the substantially same length as the width of the fixing belt 21. The base plate 31 is made of resin, such as liquid crystal polymer.

As shown in FIG. 2, the main body 32 has an upper face 32*a*, a lower face 32*b*, an upstream side end face 32*c* and a downstream side end face 32*d* in the conveyance direction Y. The upper face 32*a* is formed in a flat face. Corners between the upper face 32*a*, and the upstream side end face 32*c* and the downstream side end face 32*d* are chamfered. The lower face 32*b* faces the inner circumferential face of the fixing belt 21 at the pressing area N, and has a flat face arranged upstream in the conveyance direction Y and a curved face arranged downstream in the conveyance direction Y. The curved face is curved downward to the downstream side. Corners between the lower face 32*b*, and the upstream side end face 32*c* and the downstream side end face 32*d* are chamfered.

As shown in FIG. 3, the eighteen projections 45, the seven fixing pins 47 and the three positioning pins 49 are formed on the upper face 32*a* of the main body 32. The projections 45 each has a uniform height and has an oval cross section in which a length along the width direction W is longer than a length along the conveyance direction Y. The nine projections 45 of the eighteen projections 45 are arranged in a row along the width direction W on an upstream end portion in the conveyance direction Y, and the remaining nine projections 45 of the projections 45 are arranged in a row along the width direction W on a downstream end portion in the conveyance direction Y. In the rows, each projection 45 is arranged at the same position in the width direction W.

The seven fixing pins 47 each has the same height as the projections 45 and has a circular cross section. The three positioning pins 49 each has a height higher than the fixing pin 47 and has an outer diameter larger than the fixing pin 47. The seven fixing pins 47 and the three positioning pins 49 are arranged in a row along the width direction W between the two rows of the projections 45. The seven fixing pins 47 and the three positioning pins 49 are arranged between the adjacently arranged two projections 45 in the width direction X. In detail, the three positioning pins 49 are arranged between the first projection 45 and the second projection 45, between the fourth projection 45 and the fifth projection 45 and the eighth projection 45 and the ninth projection 45, from one end (the right end in FIG. 3) in the width direction W. The seven fixing pins 47 are arranged outside the first projection 45, between the second projection 45 and the third projection 45, between the third projection 45 and the fourth projection 45, between the fifth projection 45 and the sixth projection 45, between the sixth projection 45 and the seventh projection 45, between the seventh projection 45 and the eighth projection 45 and outside the ninth projection 45.

The sliding sheet 33 is a rectangular sheet-shaped member having the substantially same width as the length of the main body 32 of the base plate 31 and a length enough to be wrapped around the entire outer circumference of the main body 32. In detail, as shown in FIG. 2, the sliding sheet 33 has a length in which it is wrapped around the main body 32 such that an upstream side end portion 33*a* and a downstream side end portion 33*b* in the conveyance direction Y are overlapped on the upper face 32*a* of the main body 32. As shown in FIG. 3, the upstream side end portion 33*a* and the downstream side end portion 33*b* each has eighteen through holes 55, seven fixing holes 57 and three positioning holes 59. Into the eighteen through holes 55, the seven fixing holes 57 and the three positioning holes 59, the eighteen projections 45, the seven fixing pins 47 and the three positioning pins 49 of the base plate 31 are fitted respectively. The sliding sheet 33 is formed by weaving PTFE fiber and PPS fiber together, and has a heat-shrinkable property. The sliding sheet 33 has a heat-shrinkage rate of 5 to 7 at 230° C., for example.

Figure 4A:
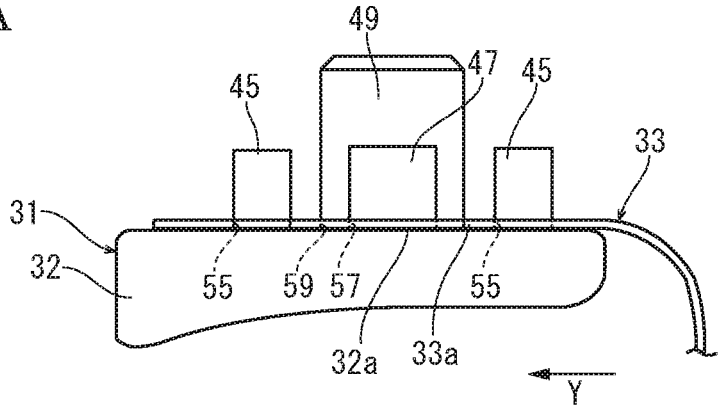
FIG. 4A is a side view explaining a process where projections of a base plate are fitted into through holes of a sliding sheet, in the fixing device according to the embodiment of the present disclosure.

Next, a forming method of the holding member 27 will be described with reference to FIGS. 4A to 4D. FIGS. 4A to 4D are side views showing the holding member 27. First, as shown in FIG. 4A, the upstream side end portion 33*a* of the sliding sheet 33 is placed on the upper face 32*a* of the main body 32, and the projections 45, the fixing pins 47 and the positioning pins 49 are fitted into the through holes 55, the fixing holes 57 and the positioning holes 59 of the upstream side end portion 33*a*, respectively.

Figure 4B:
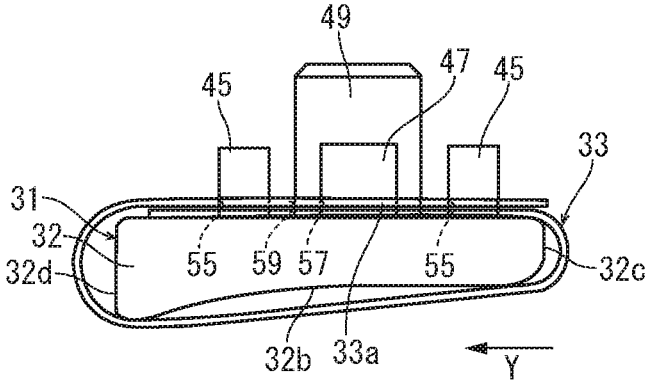
FIG. 4B is a side view explaining a process where the sliding sheet is wrapped around a main body of the base plate, in the fixing device according to the embodiment of the present disclosure.

Then, as shown in FIG. 4B, the sliding sheet 33 is wrapped around the upstream side end face 32*c*, the lower face 32*b* and then the downstream side end face 32*d* in the order. After that, the downstream side end portion 33*b* is overlapped on the upstream side end portion 33*a*, and the projections 45, the fixing pins 47 and the positioning pins 49 are fitted into the through holes 55, the fixing holes 57 and the positioning holes 59 of the downstream side end portion 33*b*, respectively. As a result, the sliding sheet 33 is wrapped around the entire outer circumference of the main body 32, and the downstream side end portion 33*b* is overlapped on the upstream side end portion 33*a*.

Figure 4C:
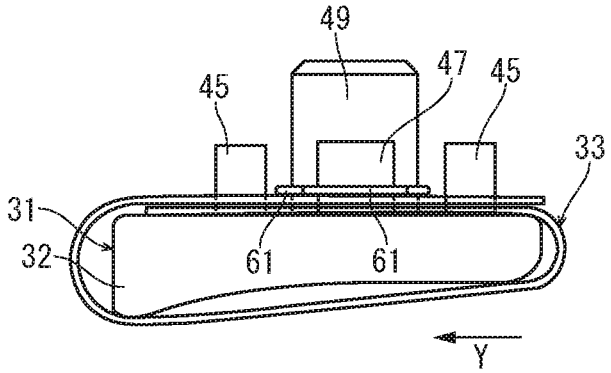
FIG. 4C is a side view explaining a process where the sliding sheet is put between the main body and a fastening member, in the fixing device according to the embodiment of the present disclosure.

Next, as shown in FIG. 4C, a CS ring 61 is inserted around each of the fixing pins 47 and the positioning pins 49. The CS ring 61 is a fastening member having an annular ring part and a plurality of elastic pieces extending from the ring part inward in a radial direction. When the CS ring 61 is inserted around each of the fixing pins 47 and the positioning pins 49, the upstream end side portion 33*a* and the downstream side end portion 33*b* of the sliding sheet 33 are put between the CS rings 61 and the upper face 32*a* of the main body 32 and fastened. In detail, the portions around the fixing holes 57 and the positioning holes 59 are put between the CS rings 61 and the main body 32.

Figure 4D:
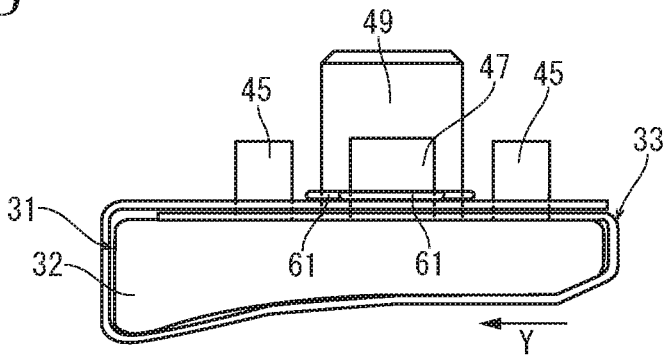
FIG. 4D is a side view explaining a process where the sliding sheet is subjected to a heat treatment, in the fixing device according to the embodiment of the present disclosure.

Then, the base plate 31 around which the sliding sheet 33 is wrapped is subjected to a heat treatment at a temperature higher than a maximum temperature where a temperature of the fixing belt 21 reaches when the fixing belt 21 is heated by the heater 23. By the heat treatment, as shown in FIG. 4D, the sliding sheet 33 is heat-shrunk around the outer circumference of the main body 32. That is, the sliding sheet 33 is shrunk in the length direction and an amount of loosed portion of the sliding sheet 33 becomes smaller than that before the heat treatment (refer to FIG. 4C). The heat treatment is preferably carried out at a temperature by about 30° C. higher than the maximum temperature of the fixing belt 21 heated by the heater 23, for example. For example, in a case where the maximum temperature of the fixing belt 21 is 200° C., the heat treatment is carried out at 230° C. for 30 minutes. The heat treatment is carried out by using an oven, for example. In some cases, silicon oil may be applied on an inner circumferential face of the sliding sheet 33.

With reference to FIG. 2 and FIG. 3 again, the holding member 27 formed in the above manner is supported by the stay 35. The positioning pins 49 of the base plate 31 are fitted into the positioning holes 41 of the stay 35 so that the base plate 31 is positioned with respect to the stay 35. Upper faces of the projections 45 and fixing pins 47 come into contact with a lower face of the stay 35.

A fixing operation of the fixing device 9 having the above described configuration will be described. First, the pressing roller 25 is driven by the motor to be rotated. The holding member 27 holds the fixing belt 21 to the pressing roller 25, and the fixing belt 21 is driven by the pressing roller 25 to be rotated in the direction opposite to the rotation direction of the pressing roller 25. At this time, the sliding sheet 33 is slid with respect to the inner circumferential face of the fixing belt 21. Additionally, the heater 23 is driven to be heated and to heat the fixing belt 21. The fixing belt 21 is heated to a fixing allowable temperature (for example, 160° C.) which allows the fixing of the toner image on the sheet S. After the fixing belt 21 is heated, the sheet S on which the toner image is transferred is conveyed to the pressing area N. At the pressing area N, the sheet S is conveyed between the fixing belt 21 and the pressing roller 25. At this time, the toner image is heated by the fixing belt 21 and pressed by the fixing belt 21 and the pressing roller 25 to be fixed on the sheet S. The sheet S on which the toner image is fixed is conveyed along the conveyance path 15.

When the fixing belt 21 is heated to the fixing allowable temperature, the sliding sheet 33 is also heated to about the fixing allowable temperature. However, because the sliding sheet 33 is subjected to the heat treatment at the temperature higher than the maximum temperature where the temperature of the fixing belt 21 reaches when the fixing belt 21 is heated by the heater 23 and is already heat-shrunk, the sliding sheet 33 is not heat-shrunk during the fixing operation. When the fixing belt 21 is driven by the pressing roller 25 to be rotated, the sliding sheet 33 is pulled downstream in the conveyance direction Y and the loosed portion of the fixing belt 21 is expanded downstream. However, because the sliding sheet 33 is heat-shrunk as described above, an expanded amount of the loosed portion is so small that the loosed portion hardly interferes with the inner circumferential face of the fixing belt 21.

As described above, according to the fixing device 9 of the present disclosure, because the sliding sheet 33 hardly interferes with the fixing belt 21, the fixing belt 21 can be smoothly rotated without interference. Accordingly, it becomes possible to inhibit the sheet jam owing to the rotation failure of the fixing belt 21.

Figure 5:
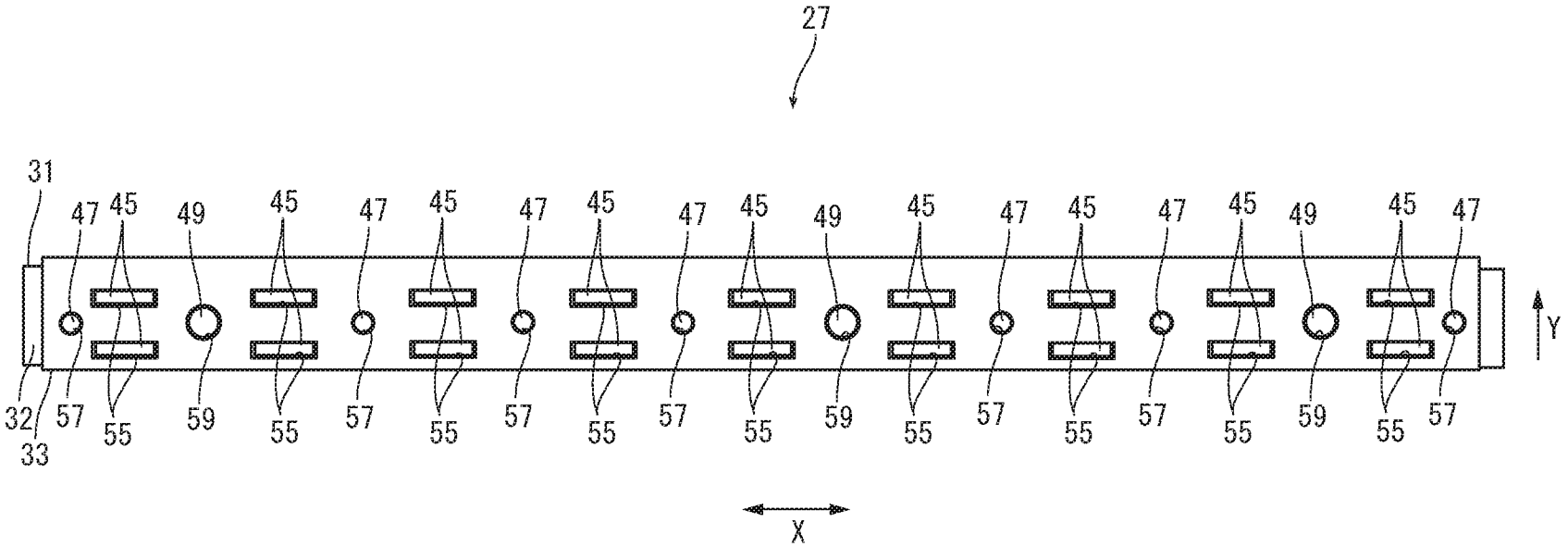
FIG. 5 is a plan view showing the sliding sheet subjected to the heat treatment before a fixing operation, in the fixing device according to the embodiment of the present disclosure.
Figure 6:
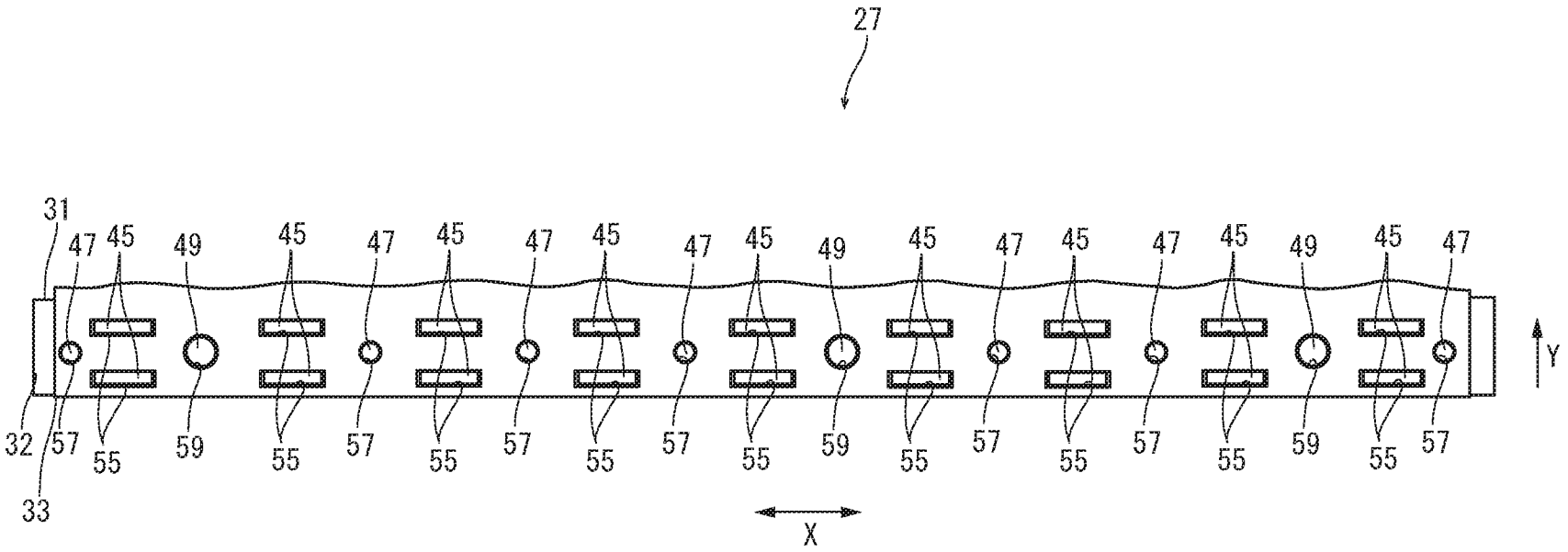
FIG. 6 is a plan view showing the heat-shrunk sliding sheet during the fixing operation, in a conventional fixing device.

The expansion of the sliding sheet 33 in both a case where the sliding sheet 33 is subjected to the heat treatment before the fixing operation and another case where the sliding sheet 33 is not subjected to the heat treatment will be described with reference to FIG. 5 and FIG. 6. FIGS. 5 and 6 are plan views showing the sliding sheet S. In each figure, the CS rings 61 are not shown.

Conventionally, during the fixing operation, the sliding sheet 33 is heated by the fixing belt 21 to be heat-shrunk. That is, the sliding sheet 33 is heat-shrunk in the state where it is pulled downstream by the fixing belt 21 and is loosened.

As a result, as shown in FIG. 6, the loosed portions are undulated. As described above, in the sliding sheet 33, the portions around the fixing holes 57 and the positioning holes 59 are put between the CS rings 61 and the main body 32 and fastened. On the other hand, the projections 45 are fitted into the through holes 55, and the portion around the through holes 55 are not fastened. Accordingly, when the sliding sheet 33 is pulled downstream by the fixing belt 21 during the fixing operation, the downstream portions of the through holes 55 are expanded larger than the downstream portions of the fixing holes 57 and the positioning holes 59, and are undulated as shown in FIG. 6. The expanded loosed portions interfere with the inner circumferential face of the fixing belt 21, and the rotation failure of the fixing belt 21 occurs. If the fixing belt 21 has an ununiform heat distribution in the width direction W, the heat-shrinking amount of the sliding sheet 33 becomes ununiform in the width direction W, and the undulating may occur.

On the other hand, in the present embodiment, the sliding sheet 33 is wrapped around the main body 3, fastened to the main body 32 and then subjected to the heat treatment to make the sliding sheet 33 heat-shrink. Because the sliding sheet 33 is wrapped around the outer circumference of the main body 32 evenly, as shown in FIG. 5, the sliding sheet 33 is heat-shrunk around the outer circumference of the main body 32 almost closely. However, because a gap is formed between the sliding sheet 33 and the outer circumference of the main body 32, the sliding sheet 33 is slightly expanded downstream during the fixing operation; the expanded amount of the loosed portion is so small that the rotation of the fixing belt 21 is not affected.

According to the present embodiment, in order to attach the sliding sheet 33 to the base plate 31, the main body 32 has the plurality of projections 45. In detail, the two rows of the nine projections 45 are aligned along the width direction W. As described above, during the fixing operation, the sliding sheet 33 is pulled in the conveyance direction Y forcefully by the fixing belt 21. Then, by fitting the plurality of projections 45 into the through holes 55 of the sliding sheet 33, it makes possible to enhance force for holding the sliding sheet 33 to the base plate 31 and to prevent the damage of the sliding sheet 33. The projection 45 has the oval cross section elongated in the width direction W. This makes a contact area between the through hole 55 and the projection 45 large when the sliding sheet 33 is pulled, and it becomes possible to prevent the damage of the sliding sheet 33 more surely.

The fixing pins 47 and the positioning pins 49 are arranged between the two lows of the projections 45 and between the adjacently arranged projections 45 in the width direction W. As a result, the through holes 55, the fixing holes 57 and the positioning holes 59 are distributed in the width direction W to prevent local decrease of strength of the sliding sheet 33.

The sliding sheet 33 is wrapped around the main body 32 such that the downstream side end portion 33*b* is overlapped on the upstream side end portion 33*a*. The upstream side end portion 33*a* is applied with force to the downstream in the conveyance direction Y by the rotation of the fixing belt 21, and is preferably not affected by the heat of the heater 23. Then, by overlapping the downstream side end portion 33*b* on the upstream side end portion 33*a*, the downstream side end portion 33*b* protects the upstream side end portion 33*a* from the heat of the heater 23. However, the upstream side end portion 33*a* may be overlapped on the downstream side end portion 33*b*.

While the above description has been described with reference to the particular illustrative embodiments, the present disclosure is not limited to the above embodiments. It is to be appreciated that those skilled in the art can change or modify the embodiments without departing from the scope and spirit of the present disclosure.

The invention claimed is:

1. A fixing device comprising:

a rotatable endless fixing member;

a heat source configured to heat the fixing member;

a pressing member configured to form a pressing area between the fixing member and the pressing member, a sheet passed through the pressing area; and a holding member configured to come into contact with an inner circumferential face of the fixing member at the pressing area and to hold the fixing member to the pressing member, wherein the holding member includes:

a base plate including a main body and a projection, the main body having one face facing the inner circumferential face of the fixing member and the other face opposite to the one face and the projection being formed on the other face; and a sliding sheet having a through hole into which the projection is fitted, the sliding sheet wrapped around the main body with the projection fitted into the through hole to be attached to the base plate, the sliding sheet configured to slide with respect to the inner circumferential face of the fixing member, wherein the sliding sheet is formed by weaving fibers together and is subjected to a heat treatment at a temperature higher than a maximum temperature where a temperature of the fixing member reaches when the fixing member is heated by the heat source, the sliding sheet being heat-shrunk around an outer circumference of the main body by the heat treatment and not being heat-shrunk during a fixing operation where the fixing member is heated to a fixing allowable temperature where a toner image is fixed on the sheet.

2. The fixing device according to claim 1, wherein the sliding sheet is subjected to the heat treatment at a temperature by at least 30° C. higher than the maximum temperature.

3. The fixing device according to claim 1, wherein the base plate includes a plurality of the projections, and the projections are arranged in two rows along a width direction perpendicular to a conveyance direction of the sheet.

4. The fixing device according to claim 1, wherein the projection has an oval cross section in which a length along a conveyance direction of the sheet is shorter than a length along a width direction perpendicular to the conveyance direction.

5. The fixing device according to claim 1, wherein the main body includes a fixing pin on the other face; and the sliding sheet includes a fixing hole into which the fixing pin is fitted, and the sliding sheet is put between a fastening member inserted around the fixing pin and the main body in a state where the fixing pin is fitted into the fixing hole.

6. The fixing device according to claim 5, wherein the base plate includes a plurality of the projections, the projections are arranged in two rows along a width direction perpendicular to a conveyance direction of the sheet, the base plate includes a plurality of the fixing pins, and the fixing pins are arranged between the two rows and between the adjacently arranged projections in the width direction.

7. An image forming apparatus comprising:

an image forming part configured to form a toner image on a sheet; and the fixing device according to claim 1, configured to fix the toner image on the sheet.

8. A method to form the holding member of the fixing device according to claim 5, the method comprising:

a step to wrap the sliding sheet around the main body and to fit the projection and the fixing pin into the through hole and the fixing hole respectively;

a step to insert the fastening member around the fixing pin and to put the sliding sheet between the fastening member and the main body; and a step to subject the sliding sheet put between the fastening member and the main body to a heat treatment at a temperature higher than a maximum temperature where a temperature of the fixing member reaches when the fixing member is heated by the heat source.

* * * * *